United States Patent [19]

Rivers

[11] Patent Number: 4,953,999

[45] Date of Patent: Sep. 4, 1990

[54] GOLF CLUB GRIP CLEANER

[75] Inventor: Joseph L. Rivers, Boston, Mass.

[73] Assignee: Randr, Inc., Cambridge, Mass.

[21] Appl. No.: 229,638

[22] Filed: Aug. 8, 1988

[51] Int. Cl.[5] ..... A47L 13/17; A47L 25/00

[52] U.S. Cl. ..... 401/9; 401/10; 401/11; 401/139; 401/207

[58] Field of Search ..... 401/139, 9, 10, 11, 401/207; 24/670

[56] References Cited

U.S. PATENT DOCUMENTS

| | | | |
|---|---|---|---|
| 834,858 | 10/1906 | Wright | 24/670 |
| 1,936,757 | 11/1933 | Garvey | 401/11 X |
| 2,147,769 | 2/1939 | Epstein | 401/139 |
| 2,908,923 | 10/1959 | Schlechter | 401/10 |
| 2,980,942 | 4/1961 | Dabney, Jr. | 401/10 |
| 3,056,998 | 10/1962 | Ebner | 401/10 |
| 3,224,029 | 12/1965 | Domingos | 15/513 |
| 3,813,722 | 6/1974 | Sapochinik | 401/10 X |
| 3,989,388 | 11/1976 | Sparr, Sr. | 401/11 |
| 4,069,894 | 1/1978 | Black | 401/11 X |
| 4,087,878 | 5/1978 | Grieshaber et al. | 15/111 |
| 4,210,974 | 7/1980 | Stoltzman | 401/11 X |
| 4,411,040 | 10/1983 | Sharrow et al. | 15/104.94 |
| 4,419,781 | 12/1983 | Meegan | 15/210 B |
| 4,464,072 | 8/1984 | Norwell | 401/137 |
| 4,676,839 | 6/1987 | Osborn | 134/25.4 |
| 4,701,968 | 10/1987 | Stoltzman | 15/21 A |

FOREIGN PATENT DOCUMENTS

| | | | |
|---|---|---|---|
| 3118196 | 12/1982 | Fed. Rep. of Germany | 401/10 |
| 461245 | 12/1913 | France | 24/670 |
| 2192798 | 1/1988 | United Kingdom | 401/10 |

*Primary Examiner*—Steven A. Bratlie

*Attorney, Agent, or Firm*—Wolf, Greenfield & Sacks

[57] ABSTRACT

A portable hand-held golf club grip cleaner includes an elongate housing having open ends and a longitudinal slot. The housing contains a removable cleaning pad insert and also carries a reservoir and spring device to wet the pads. The golf club grip is insertable transversely into the pads through the longitudinal slot and can be drawn longitudinally through the pad. The device is conveniently attached to a golf bag.

8 Claims, 3 Drawing Sheets

GOLF CLUB GRIP CLEANER

FIELD OF THE INVENTION

This invention relates to golf accessories and particularly to a portable hand-held device for cleaning the grip of a golf club.

BACKGROUND OF THE INVENTION

Among the paraphernalia typically carried by golfers is a towel to wipe clean the grip of a golf club after or before the club is used. If the club grip is not cleaned of perspiration and grime, that may adversely affect the grip of the golfer on a club. Therefore, it is desirable to maintain the grip clean not only to assure that the golfer will be able to grip the club securely but also to enhance the life of the golf club grip. Merely wiping the grip with a towel often may not clean effectively the grip and may even work grime and dirt into the grip thereby aggravating the condition. There is a need, therefore, for an effective, easily portable golf club grip cleaner. It is among the general objects of the invention to provide such a device.

SUMMARY OF THE INVENTION

The device includes a generally tubular, elongate housing, open at its ends and having a longitudinal slot formed along its side. The housing contains a replaceable pad arrangement that is constrained within the housing to a generally tubular shape corresponding to that of the housing. The pad is open at its ends and defines a longitudinally slot receptive to the golf club grip. The housing also carries a liquid reservoir with a manually pumpable dispenser that squirts water or liquid cleaner against the pad or the club grip. The club grip can be inserted into the pad transversely through the slot and then drawn axially through the pads. The pad arrangement has three sections including a wetting section, a scrubbing section and a wiping section and is replaceable. The device is detachably hung from a golf bag.

It is among the general objects of the invention to provide a hand-held portable golf club grip cleaner.

Another object of the invention is to provide a hand-held portable golf club grip cleaner that utilizes pads to clean the grip and in which the pads are replaceable.

A further object of the invention is to provide a golf club grip cleaner of the type described that is easy to use, is relatively inexpensive and is effective to maintain golf club grips in clean condition.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
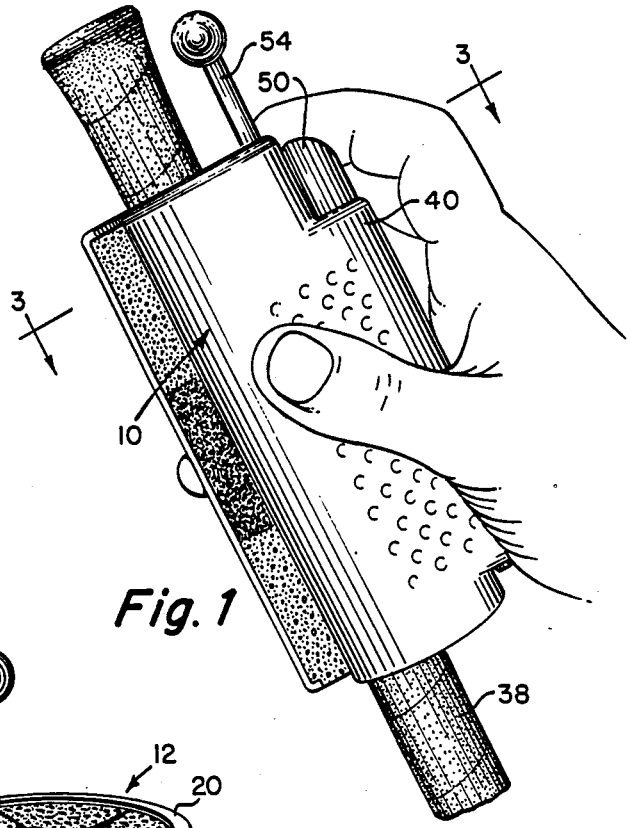
FIG. 1 is an illustration of the device held in one hand with a portion of a golf club grip extending through the device.
Figure 2:
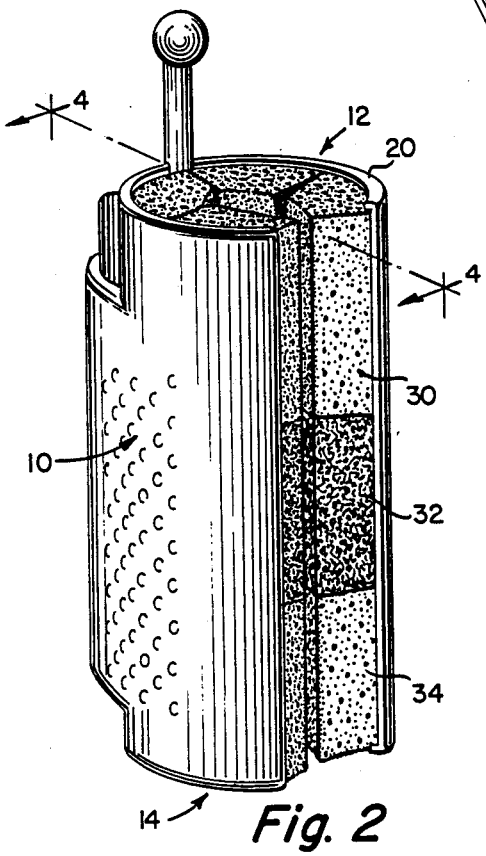
FIG. 2 is a perspective illustration of the device as seen somewhat from its forward facing slot end.

As shown in the drawings, the device includes a housing indicated generally by the reference character 10 which may be molded from an appropriate durable plastic. The housing is generally tubular and may be considered as having upper and lower ends 12, 14, respectively. The housing 10 includes a generally circular wall 16 formed with a longitudinally extending slot 18 along its front. The upper and lower ends 12, 14 of the housing 10 are open and are formed with generally circular radially inwardly extending flanges 20, 22, respectively. The longitudinally extending edges of the circular wall 16 that define the slot 18 also may be formed with longitudinal flanges 24.

Figure 5:
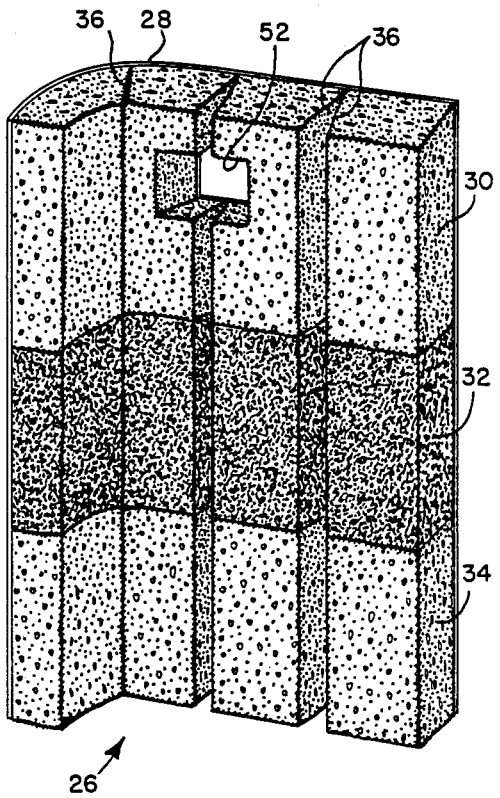
FIG. 5 is an illustration of the cleaning pad array separated from the device.
Figure 6:
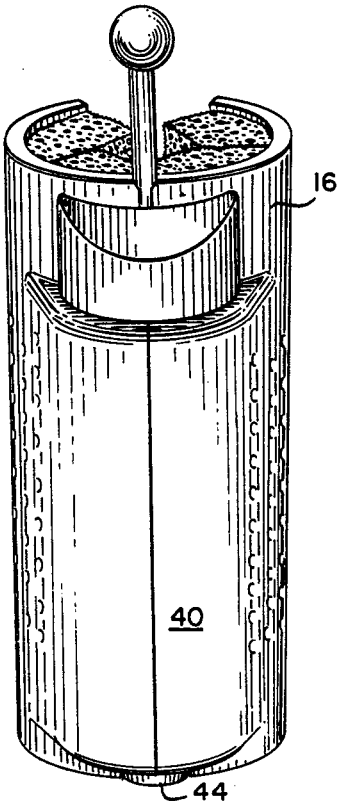
FIG. 6 is a rear illustration of the device.

The housing 10 is adapted to receive and constrain a cleaning pad insert, illustrated in FIG. 5. The cleaning pad insert 26 preferably includes a flexible backing sheet 28 which may be formed from an appropriate plastic. The backing sheet is dimensioned so that it may be curved into a generally tubular configuration to fit firmly between the upper and lower flanges 20, 22 and the longitudinal flanges 24 of the housing. In the illustrative embodiment, the cleaning pad insert 26 includes an upper arrangement of soft liquid absorbing foam plastic wetting pads 30, an intermediate segment of coarse scrubbing pads 32 which typically are formed from a harder plastic material (such as non-woven plastic filament) and lower wiping pads 34 that are formed from relatively soft foam plastic adapted to absorb water. The pads 30, 32, 34 may be attached as by adhesive or otherwise to the backing sheet 28.

Figure 3:
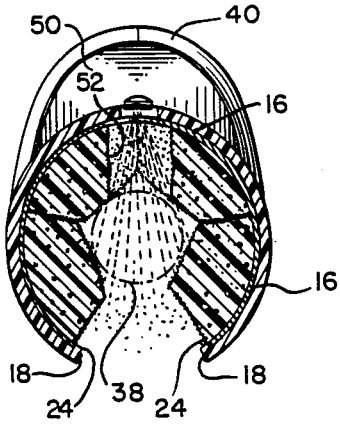
FIG. 3 is a sectional illustration of the device as seen along the line 3—3 of FIG. 1.

The arrangement of pads preferably is as shown in FIG. 5 in which there are several groups of pads 30, 32, 34 arranged end to end in separate rows. Each of the rows may be of generally trapezoidal cross-sectional configuration, as suggested in FIG. 3, such that when the pad insert 26 is rolled to a generally tubular configuration, the facing edges 36 will contact each other. The backing sheet 28 is dimensioned so that when curved, it will fit snugly against the generally cylindrical inner surface defined by the circular wall 16 with the edges of the backing sheet 28 being constrained by the upper and lower flanges 20, 22 and longitudinal flanges 24. When so constrained, the resilient engagement of the edges 36 of the pad segments against each other coupled with the natural resilience of the backing sheet 28 retains the pad insert 26 locked into its configuration within the housing 10. The pad insert 26, however, may be easily removed when desired either to clean it or to replace it, simply by compressing the free longitudinal ends of the insert 26 together. From the foregoing, and as illustrated in FIGS. 1 and 3, it will be appreciated that the pad insert 26 when contained in the housing 10, defines a longitudinally extending slot aligned with the slot 18 of the housing 10 and into which may be inserted transversely (as suggested in FIG. 1) the grip 38 of a golf club.

Figure 4:
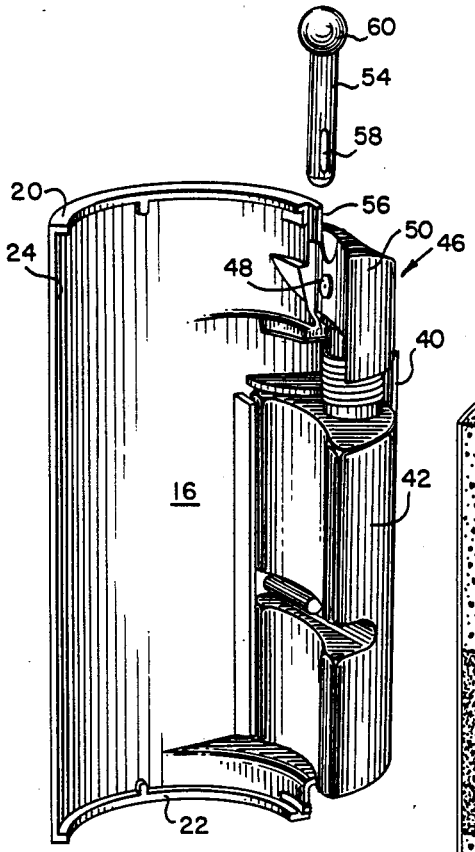
FIG. 4 is a fragmented illustration of the housing with one side of the housing separated and illustrating the reservoir and liquid dispensing mechanism.
Figure 7:
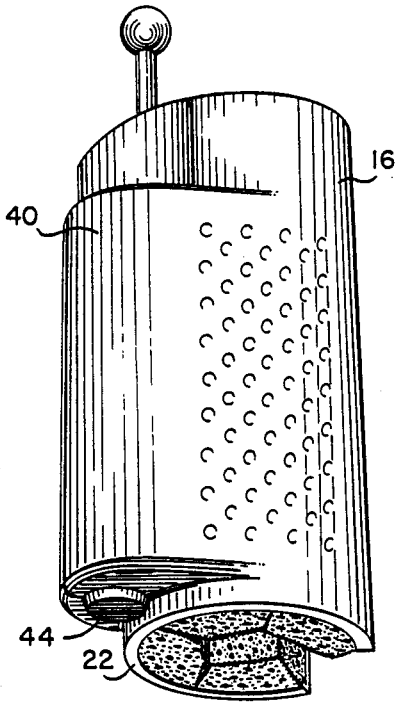
FIG. 7 is a perspective illustration of the device as seen in a bottom quartering view.

The device also incorporates a self-contained supply of water or cleaning liquid further to enhance the effectiveness of the device. As shown in FIGS. 3 and 4, the rear portion 40 of the housing 10 extends rearwardly from the circular wall 16 and houses a reservoir tank 42. The reservoir tank 42 may be filled from an opening in the exposed bottom of the reservoir tank 42 which is illustrated in FIG. 7 as being closed by a removable plug 44. The reservoir tank 42 carries a manually operable actuator assembly 46 that includes a nozzle 48 and a depressing plunger 50 that is biased in the upward direction by an internal spring (not shown). The plunger 50 extends upwardly beyond the upper end of the rear portion 40 of the housing 10 and is easily accessible by the user's finger as illustrated in FIG. 1. In order that the spray from the nozzle 48 may be directed against the wetting pads 30 as well as the golf club grip 38, an opening 52 is formed in the rear portion of the wetting pads 30 as indicated in FIGS. 3 and 5.

Figure 8:
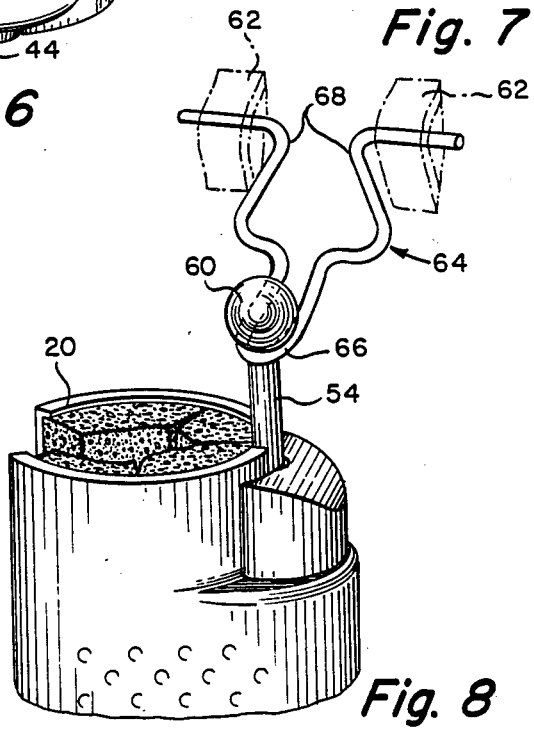
FIG. 8 is an illustration of the device and the manner in which it is detachably connected to a golf bag.

The device may be easily and detachably mounted to a golf bag by means of the arrangement illustrated in FIG. 8. The device may be provided with an upwardly extending stem 54 that may be attached to the housing, as by a tongue and slot connection 56, 58 in which the tongue 56 is formed as an integral part of the housing 10. The upper end of the stem 54 may be provided with an enlarged ball 60. The stem 54 and ball 60 may be formed from a single piece of rubber. The stem and ball 54, 60 are intended to be detachably mounted to the golf bag, indicated in phantom at 62 by a wire clip 64. The wire clip is formed to define a bight 66 and a widened region 68. The ball 60 is capturable in the narrow bight 66 but may be detached by sliding the stem 54 along the bight into the enlarged region 68.

The device may be formed in molded half sections, as illustrated, or, alternately, the housing 10 may be molded in a single piece as will be apparent to those skilled in the art.

From the foregoing, it will be appreciated that the device is easily used. It may be grasped easily in one hand by the user. The actuator assembly 46 is operated to wet the wetting pads 30. The user, while holding the device in one hand, inserts the golf club grip through the transverse slot into the pads. Once in the pads, the user then draws the golf club axially through the device. The user may operate the actuator assembly 46 while doing so to direct cleaning liquid or water directly onto the golf club grip, should that be desired. Thus, the wetting pads in the upper portion of the device wet the golf club grip, the scrubbing pads 32 scrub grime off of the grip, and the wiping pads 34 wipe the grip clean and dry. The reservoir is easily refilled and is easily detachably carried on a golf bag. The pad insert conveniently may be removed for cleaning or for replacement.

It should be understood, however, that the foregoing description of the invention is intended merely to be illustrative thereof and that other embodiments and modifications may be apparent to those skilled in the art without departing from its spirit.

having thus described the invention, what I desire to claim and secure by Letters Patent is:

I claim:

1. A hand-held portable device for cleaning a golf club grip comprising:

a generally tubular, elongate housing open at its ends and having a slot extending along its length from one end to the other end, the slot communicating with the open ends;

cleaner pad means mounted within the housing and having a longitudinally extending slot and open ends, said slot and open ends being aligned with the slot and open ends of the housing, the cleaner pad means being generally U-shaped in transverse cross-section, the cleaner pad means including a wetting pad and a flexible, resilient backing sheet to which the wetting pad is mounted;

the ends of the housing having flanges for engagement with and containment of opposed ends of the backing sheet;

means for precluding rotation of the cleaner pad means about a longitudinally extending axis comprising flanges extending along the edges of the longitudinally extending slot for engaging the backing sheet of the pad assembly;

means carried by the housing for wetting the wetting pad including a liquid reservoir carried by the housing and pump means for pumping liquid from the reservoir onto the wetting pad;

whereby a golf club grip may be inserted into the cleaner pad means transversely through the slots in the housing and the cleaner pad means and may be substantially encompassed by the cleaner pad means, and may then be drawn longitudinally whereby the cleaner pad means may effect a cleaning action on the grip.

2. A device as defined in claim 1 further comprising said cleaner pad means being detachably mounted in the housing.

3. A device as defined in claims 1 or 2 wherein said cleaner pad means has three sections including a wetting section, a scrubbing section and a wiping section for wetting, scrubbing and wiping, respectively, the golf club grip as the golf club grip is drawn longitudinally through the pad.

4. A device as defined in claim 3 wherein each of said pad sections is of generally trapezoidal cross-sectional configuration.

5. A device as defined in claim 1 further comprising:

said liquid reservoir being mounted at the rearward portion of the housing and having an outlet nozzle extending in a forward direction;

an aperture formed in the cleaner pad means in alignment with the nozzle to permit spray from the nozzle to be emitted toward the more forwardly disposed portions of the pad means.

6. An apparatus as defined in claim 1 further comprising:

means for detachably connecting the device to a golf bag.

7. A device as defined in claim 6 wherein the means for detachably connecting the device to the golf bag comprises:

an upwardly extending stem connected to the housing, the stem having an enlarged ball at its upper end;

a harness mounted to the golf bag and having a narrow bight portion and a wider enlarged portion, the bight portion defining a slot narrower than the diameter of the ball and the enlarged portion defining a slot greater in dimensions than the diameter of the ball whereby the stem may be advanced from the bight to the enlarged portion and be thereby detached.

8. A device as defined in claim 3 wherein the three sections of the cleaning pad are disposed serially along the length of the device.

* * * * *